United States Patent [19]

Sugiyama

[11] Patent Number: 5,072,924

[45] Date of Patent: Dec. 17, 1991

[54] PAPER FEEDING CONTROL DEVICE

[75] Inventor: Tsukasa Sugiyama, Moriguchi, Japan

[73] Assignee: Mita Industrial Co., Ltd., Osaka, Japan

[21] Appl. No.: 527,378

[22] Filed: May 23, 1990

[30] Foreign Application Priority Data

May 29, 1989 [JP] Japan ..... 1-137167
Jun. 2, 1989 [JP] Japan ..... 1-141850

[51] Int. Cl.[5] ..... B65H 7/08

[52] U.S. Cl. ..... 271/110; 271/227; 271/265

[58] Field of Search ..... 271/110, 111, 270, 265, 271/258, 259, 227

[56] References Cited

U.S. PATENT DOCUMENTS 4,171,130 10/1979 Jeschke et al. ..... 271/111 X
4,589,765 5/1986 Perun et al. .

FOREIGN PATENT DOCUMENTS 0219244 4/1987 European Pat. Off. .
2916119 10/1979 Fed. Rep. of Germany .
0216850 12/1983 Japan ..... 271/259
0116433 5/1987 Japan ..... 271/111
0175359 8/1987 Japan ..... 271/110

OTHER PUBLICATIONS

Patent Abstracts of Japan, vol. 10, No. 105, Apr. 19, 1986.

Patent Abstract of Japan, vol. 9, No. 73, Apr. 3, 1985.

*Primary Examiner*—H. Grant Skaggs
*Attorney, Agent, or Firm*—Beveridge, DeGrandi & Weilacher

[57] ABSTRACT

In a paper feeding control device according to a first embodiment of the invention, paper sheets delivered from paper containing sections are stopped once when their ends are detected by a paper detecting means. The paper sheet starts to be fed from the position where it is stopped, and a subsequent paper sheet is delivered at intervals of time corresponding to the minimum spacing required between paper sheets. Accordingly, even if the spacing between sheets is below the minimum because of slipping of the sheets during feeding, the sheets tend not to collide with each other and jamming is less likely. In a second embodiment of the invention, with continuously feeding paper sheets, two conditions are ANDed, namely, the elapse of time corresponding to the ideal spacing with which sheets are fed and the elapse of time corresponding to the minimum spacing required between the sheets. This ANDing is used to control the timing of the feeding of the subsequent sheet. The sheets are thus suitably spaced apart from each other. Accordingly, even if the ends of the sheets are out of line with each other in the paper containing section, or if the sheets are delivered slightly early or slightly late, or if the sheets slip while being fed or coveyed, there is less likelihood of a paper jam.

6 Claims, 8 Drawing Sheets

PAPER FEEDING CONTROL DEVICE

BACKGROUND OF THE INVENTION

The present invention relates generally to a paper feeding control device supplied to an electrophotographic copying apparatus, a printing machine or the like, and more particularly, to an improvement of a paper feeding control device capable of continuously feeding paper sheets at desired intervals.

For example, an electrophotographic copying apparatus is provided with a paper feeding control device for deliverying paper sheets contained in a paper containing section such as a paper cassette or a paper deck sheet by sheet to feed the same to an image forming section.

In a so-called high speed electrophotographic copying apparatus capable of copying on a relatively large number of paper sheets per unit time, such control has been conventionally exercised that the subsequent paper sheet starts to be fed after a constant time period since the previous paper sheet was fed by assuming that processing of the previous paper sheet was proceeds as planned, so as to increase the copy speed.

However, this control has the disadvantage in that the spacing between paper sheets is decreased, causing a paper jam or causing a delay of paper feed timing of feeding paper sheets to an image forming section (so-called registration timing) if paper sheets which are being fed slip in a conveying path or the ends of the paper sheets which start to be fed are somewhat out of line with each other in a paper containing section.

As the prior art for solving such a disadvantage, such control has been known that ideal time for conveying paper sheets is compared with actual time for conveying paper sheets to feed back the difference therebetween to a paper feed timing in a registration section, as described in, for example, JP-A-59-212340/1984.

In a recent high-speed electrophotographic copying apparatus, however, the capacity thereof is increased so as to allow continuous copying on a lot of paper sheets with the increase in speed thereof. Therefore, a conveying path from a paper containing section to a registration section for feeding paper sheets tends to be longer. In such a high-speed electrophotographic copying apparatus having a long conveying path, however, if paper sheets are continuously fed at constant time intervals as described above, a state occurs in which a plurality of paper sheets exist on the conveying path.

In such a state, the control described in the above described JP-A-59-212340/1984 has the disadvantage of causing a paper jam rather than being advantageous.

The reason for this is that the front end of the subsequent paper sheet which has been already being conveyed may, in some cases, collide with the rear end of the previous paper sheet which temporarily stops in the registration section, while the slip of the previous paper sheet is detected and the paper sheet is stopped once in the registration section to control the paper feed timing.

SUMMARY OF THE INVENTION

An object of the present invention is to provide a paper feeding control device for feeding paper sheets contained in paper containing sections to a predetermined processing section one sheet by one, which is suitable for such a large capacity and high speed paper feeding device that a plurality of paper sheets simultaneously exist on a conveying path.

The first feature of the invention is related to a paper feeding control device comprising paper feeding means for delivering paper sheets contained in paper containing sections, paper detecting means provided in predetermined positions of a paper conveying path for detecting the end and the rear end of the paper sheet delivered by the paper feeding means, time measuring means for measuring time t1 corresponding to the predetermined minimum spacing between paper sheets required, and paper feeding control means for initiating the time measuring means and the paper feeding means in response to the detection of the rear end of the paper sheet by the paper detecting means, stopping the paper feeding means once in response to the detection of the end of a paper sheet subsequent to the previous paper sheet by the paper detecting means and resuming an operation of the paper feeding means in response to a time-up output of the time measuring means.

The paper sheets delivered from the paper containing sections are stopped once when their ends are detected by the paper detecting means by the function of the paper feeding control means. The paper sheets start to be fed at the position where they are stopped. Accordingly, the paper sheets always start to be fed at their regular position even if the ends of the paper sheets are out of line with each other in the paper containing section.

Furthermore, the subsequent paper sheet is delivered at intervals of the time t1 corresponding to the minimum spacing between paper sheets required by the time measuring means. Accordingly, even if the spacing between paper sheets is decreased to desired spacing or less by the slip of the paper sheets during feeding, the paper sheets hardly collide with each other and the paper jam or the like hardly occurs.

The second feature of the invention is related to a paper feeding control device comprising paper feeding means for delivering paper sheets contained in paper containing sections, paper detecting means provided in predetermined positions of a paper conveying path for detecting the end and the rear end of the paper sheet delivered by the paper feeding means, first time measuring means for measuring time t1 corresponding to the predetermined minimum spacing between paper sheets required, second time measuring means for measuring time t2 corresponding to the predetermined ideal spacing with which paper sheets are fed, and paper feeding start control means for starting a time measuring operation of the second time measuring means in response to the delivery of the paper sheets by the paper feeding means, starting time measuring operation of the first time measuring means in response to the detection of the rear end of the paper sheet by the paper detecting means and delivering the subsequent paper sheet in response to a later one of time-up signals outputted from the two time measuring means.

According to the second feature of the invention, in continuously feeding the paper sheets, the first time measuring means outputs a time-up signal which is used as a basis for the spacing between paper sheets conveyed on the conveying path. In addition, the second time measuring means outputs a time-up signal which is used as a basis for the spacing with which paper sheets are fed. The paper feeding start control means starts to feed the subsequent paper sheet on the basis of the later one of both the time-up signals. Accordingly, the paper sheets to be continuously fed are always fed with constant spacing with which paper sheets are fed and with predetermined spacing between paper sheets.

As described in the foregoing, the timing of starting to feed the subsequent paper sheet is controlled by using the first time measuring means and the second time measuring means to AND two conditions, that is, the elapse of the time t2 corresponding to the ideal spacing with which paper sheets are fed and the elapse of the time t1 corresponding to the minimum spacing between paper sheets required. Accordingly, the spacing between paper sheets continuously conveyed is always set to the most suitable one. Consequently, even if the ends of the paper sheets are out of line with each other in the paper containing section and the paper sheets are delivered slightly earlier or later at the time of starting to feed the paper sheets or the paper sheets slip while being fed and conveyed, there occurs no paper jam or the like on the conveying path. In particular, the paper feeding control device can be made most suitable for a large capacity and high speed image processing apparatus.

The foregoing and other advantages of the present invention will be more apparent from the following description when taken in conjunction with the accompanying drawings.

DESCRIPTION OF THE PREFERRED EMBODIMENTS

Figure 2:
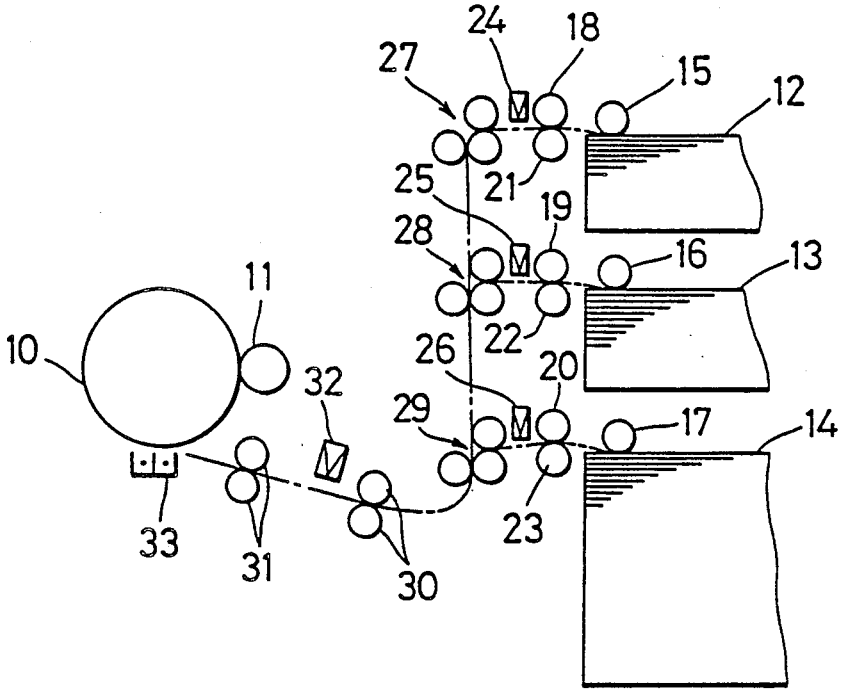
FIG. 2 is a diagram showing the schematic construction of main parts of a paper feeding mechanism.

Referring now to the drawings, an electrophotographic copying apparatus will be described in detail by way of example. Outline of Electrophotographic Copying Apparatus FIG. 2 is an illustration showing the schematic construction of a paper feeding mechanism of the electrophotographic copying apparatus.

This electrophotographic copying apparatus comprises three paper containing sections 12, 13 and 14. Preliminary rollers 15, 16 and 17, paper feed rollers 18, 19 and 20, retard rollers 21, 22 and 23, and paper detecting switches 24, 25 and 26 are respectively provided corresponding to the paper containing sections 12, 13 and 14. The preliminary rollers 15, 16 and 17 are used for delivering paper sheets respectively contained in the corresponding paper containing sections 12, 13 and 14 in descending order. In addition, the paper feed rollers 18, 19 and 20 are used for sending out the paper sheets delivered. On the other hand, the retard rollers 21, 22 and 23 provided so as to be paired with the paper feed rollers 18, 19 and 20 are rotated by the torque weaker than that in the paper feed rollers in the direction opposite to the corresponding paper feed rollers to prevent the overlapped sheet transfer of the paper sheets by the paper feed rollers 18, 19 and 20. In general, operations of pairs of the preliminary rollers, the paper feed rollers and the retard rollers are simultaneously started and stopped by paper feed clutches (not shown), respectively. The pairs constitute a paper feeding mechanism.

The ends and the rear ends of the paper sheets delivered by the paper feeding mechanism are detected by the paper feed switches 24, 25 and 26, respectively.

The paper sheets fed are conveyed by feed rollers 27, 28 and 29, to be fed to a registration roller 31 through a loop roller 30. A registration switch 32 is provided on the downstream side of the loop roller 30 in the direction in which the paper sheets are conveyed and on the upstream side of the registration roller 31. This registration switch 32 allows the paper sheets fed to the registration roller 31 to be detected. The registration roller 31 feeds the paper sheets to a photosensitive drum 10 in predetermined timing. The loop roller 30 provided on the upstream side of the registration roller 31 is used for further feeding paper sheets when the paper sheets conveyed are stopped by the collision of their ends with the registration roller 31, causing constant deflection (loop) on the paper sheets on this side of the registration roller 31. If the deflection is thus caused on the paper sheets, the ends of the paper sheets can be considerably applied to the registration roller 31, allowing oblique feeding of the paper sheets to be compensated for.

The paper sheets fed by the registration roller 31 are in close contact with the surface of the photosensitive drum 10. The toner image developed by a developing device 11 is transferred by a transferring corona discharger 33.

FIRST EMBODIMENT

Figure 3:
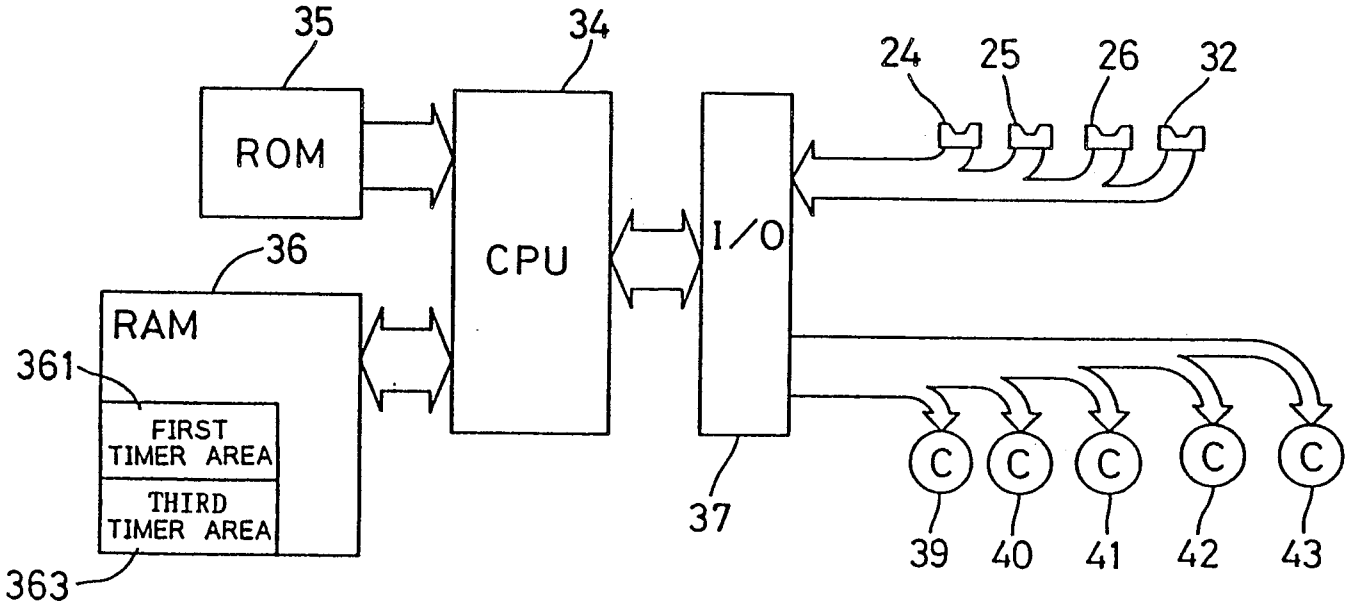
FIG. 3 is a block diagram showing the construction of an electrical circuit according to an embodiment of the feature of the invention.

FIG. 3 is a block diagram showing the construction of an electrical circuit for operating the mechanism shown in FIG. 2. The electrical circuit has a structure comprising a CPU 34 which is a control center, a ROM 35 storing an operation program of the CPU 34, a RAM 36 for storing data or the like, and an input/output interface 37. The RAM 36 comprises a first timer area 361 and a third timer area 363 which are required for control as described below.

Both outputs of the above described paper feed switches 24, 25 and 26 and an output of the above registration switch 32 are applied to the CPU 34 through the input/output interface 37. In addition, a control signal outputted from the CPU 34 is applied to paper feed clutches 39, 40 and 41, a loop clutch 42 and a registration clutch 43.

The paper feed clutches 39, 40 and 41 are used for switching the start/stop of operations of the paper feeding mechanism (a pair of the preliminary roller 15, the paper feed roller 18 and the retard roller 21, a pair of the preliminary roller 16, the paper feed roller 19 and the retard roller 22 and a pair of the preliminary roller 17, the paper feed roller 20 and the retard roller 23), respectively. The loop clutch 42 is used for switching the start/stop of an operation of the loop roller 30. The registration clutch 43 is used for switching the start/-stop of an operation of the registration roller 31.

Figure 1A:
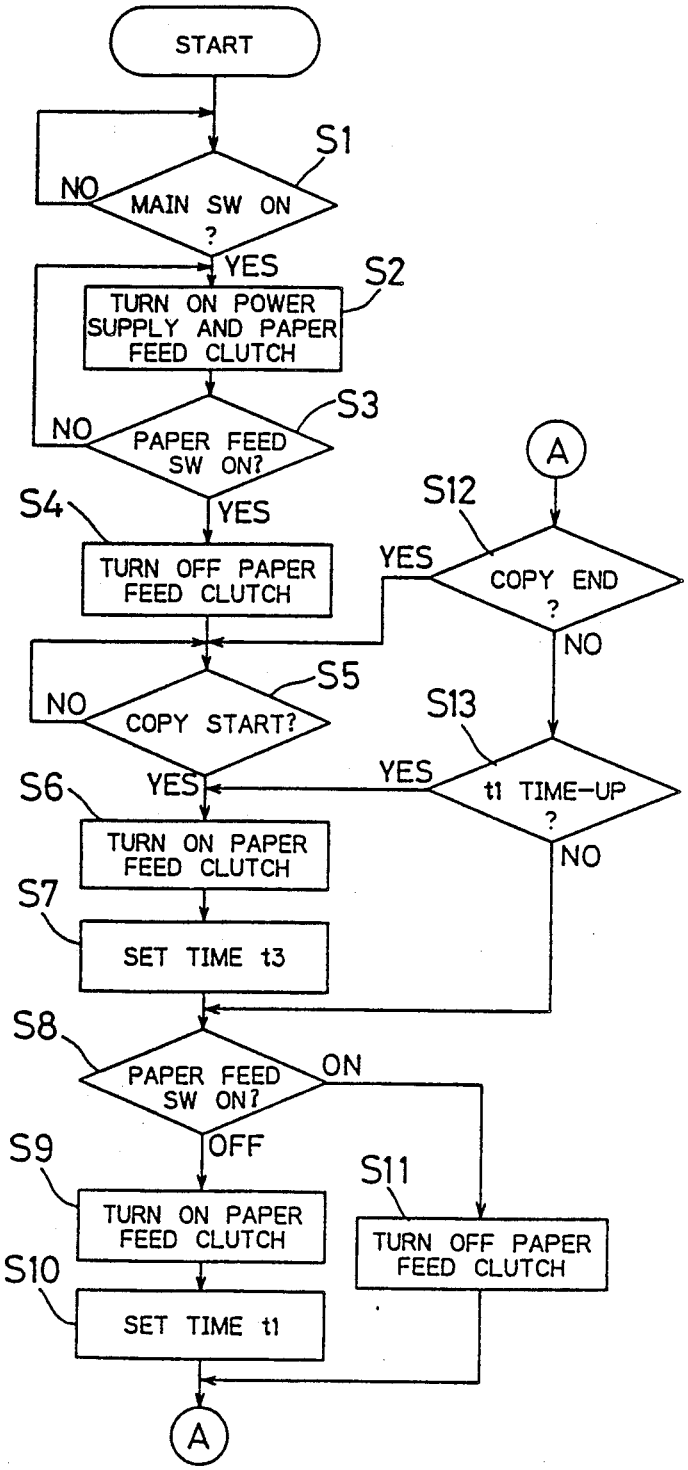
FIGS. 1A, 1B and 1C are flo charts showing a control operation according to an embodiment of the first feature of the invention.
Figure 1B:
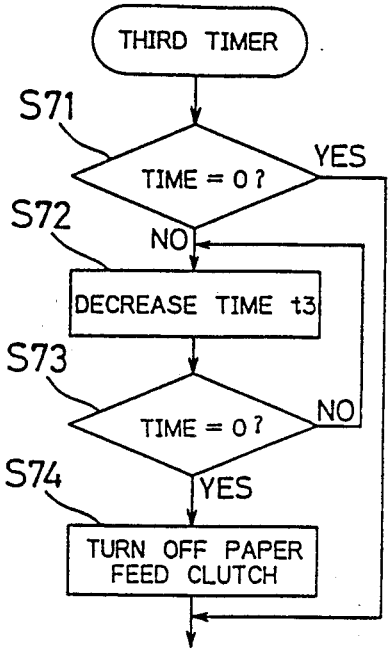
Figure 1C:
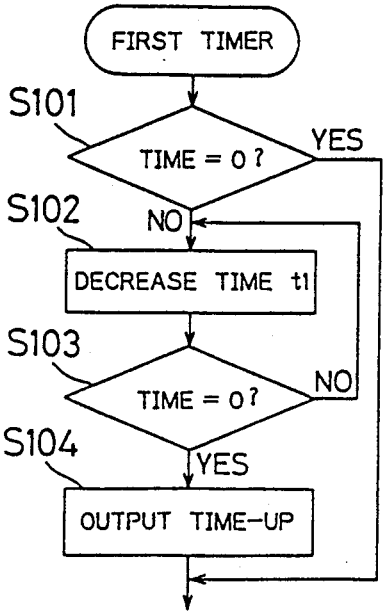
Figure 4:
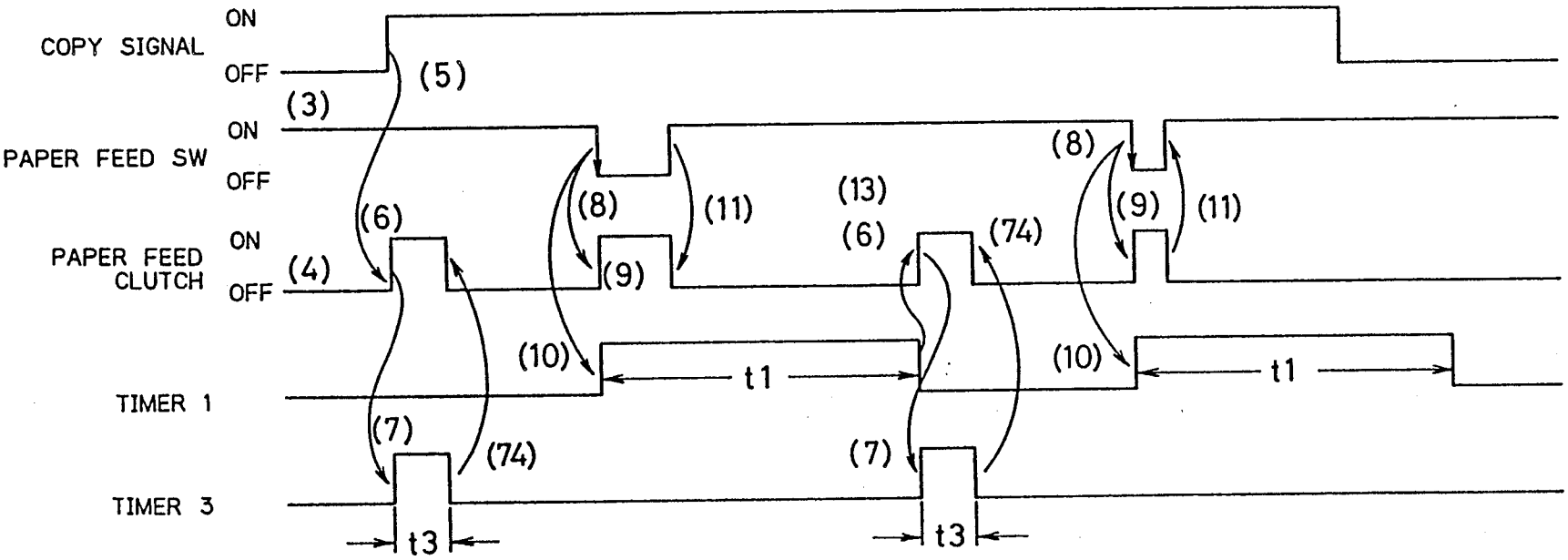
FIG. 4 is a timing chart for explaining a control operation according to the first feature of the invention.

FIGS. 1A, 1B and 1C are flow charts showing a control operation of the paper feeding mechanism of this electrophotographic copying apparatus. FIG. 4 is a timing chart showing an operation of this electrophotographic copying apparatus, which shows the relation of the paper feed clutches 39, 40 and 41, the paper feed switches 24, 25 and 26 and timers. In FIG. 4, the sections corresponding to control denoted by numbers of the steps shown in FIGS. 1A and 1B are given numbers put in parentheses.

Referring now to FIGS. 2 to 4, description is made of the control operation according to the present embodiment in accordance with the flow of FIGS. 1A, 1B and 1C.

When a main switch of the electrophotographic copying apparatus is turned on (step S1), the CPU 34 turns the power supply on and turns the three paper feed clutches 39, 40 and 41 on (step S2). Then, the CPU 34 turns the corresponding paper feed clutches 39, 40 and 41 off (step S4) in response to the transition of the paper feed switches 24, 25 and 26 to the on-state (step S3).

Consequently, the ends of the uppermost ones of the paper sheets contained in the three paper containing sections 12, 13 and 14 are respectively delivered to the positions of the paper feed switches 24, 25 and 26, to be brought in line with each other.

In this state, the CPU 34 then waits for a copying start signal to be applied by, for example, depressing a print button of a data input section (step S5). If the copying start signal is applied, the CPU 34 turns the corresponding paper feed clutch 39, 40 or 41 on so as to feed the paper sheets selected (step S6).

Furthermore, a third timer for turning the paper feed clutches off is set using the third timer area 363 (step S7).

This third timer performs a time subtracting operation as shown in the steps S71 to S73 in FIG. 1B. The CPU 34 turns the paper feed clutch 39, 40 or 41 off which is turned on after an elapse of constant time t3 (step S74). This third timer performs a function of sending the paper sheets delivered to the positions of the paper feed switches 24, 25 and 26 into the feed rollers 27, 28 and 29.

When the paper sheets start to be fed by turning the paper feed clutch on in the above described step S6, the paper sheets are conveyed by the feed roller 27, 28 or 29. The rear ends of the paper sheets pass through the paper feed switch 24, 25 or 26. At that time, the paper feed switch 24, 25 or 26 is turned off (step S8). Consequently, the CPU 34 turns the paper feed clutch 39, 40 or 41 on again in response to the detection of a rear edge of the paper feed switch 24, 25 or 26 (step S9) and sets predetermined time t1 in the first timer area 361 for setting the spacing between paper sheets in the RAM 36 to initiate a first timer (step S10).

The time t1 is set to one corresponding to the minimum spacing between paper sheets required, that is, the spacing between the rear end of the previous paper sheet and the end of the subsequent paper sheet.

The first timer performs a time substracting operation as shown in the steps S101 to S104 in FIG. 1C.

When this set time t1 finishes being measured (step S104), the CPU 34 determines the output (step S13), to repeat the same control as described above, that is, to turn the paper feed clutch 39, 40 or 41 on (step S6) and to initiate the third timer for turning the paper feed clutches off (step S7).

If the first timer does not reach the full count in the step S13, the CPU 34 turns the paper feed clutch 39, 40 or 41 off in response to the detection of a front edge of the paper feed switch 24, 25 or 26 in the step S8 (step S11).

Additionally, when copying is terminated in the step S12, control is returned to the step S5.

Meanwhile, such construction that the number of copies is subtracted by a counter for each copy processing on one paper sheet if the number of copies is set, for example, and a copying signal is applied to the CPU 34 until the number of the remaining paper sheets becomes "0" or another construction can be employed so as to determine whether or not copying is terminated.

In the present embodiment, the foregoing control is exercised. Accordingly, the ends of the paper sheets are previously delivered to the positions of the paper feed switches 24, 25 and 26 before the paper sheets start to be fed, and the ends of the paper sheets are always at the regular position at the time of starting to feed the paper sheets. Consequently, even if the ends of the paper sheets are somewhat out of line with each other in the paper containing section 12, 13 or 14, the ends of the paper sheets are always at the regular position at the time of starting to feed the paper sheets.

Furthermore, the subsequent paper sheet is delivered with spacing between paper sheets required. Accordingly, even if the spacing between paper sheets is decreased to desired spacing or less by the slip of the paper sheets during feeding, the paper sheets hardly collide with each other and the paper jam or the like hardly occurs.

SECOND EMBODIMENT

Figure 6:
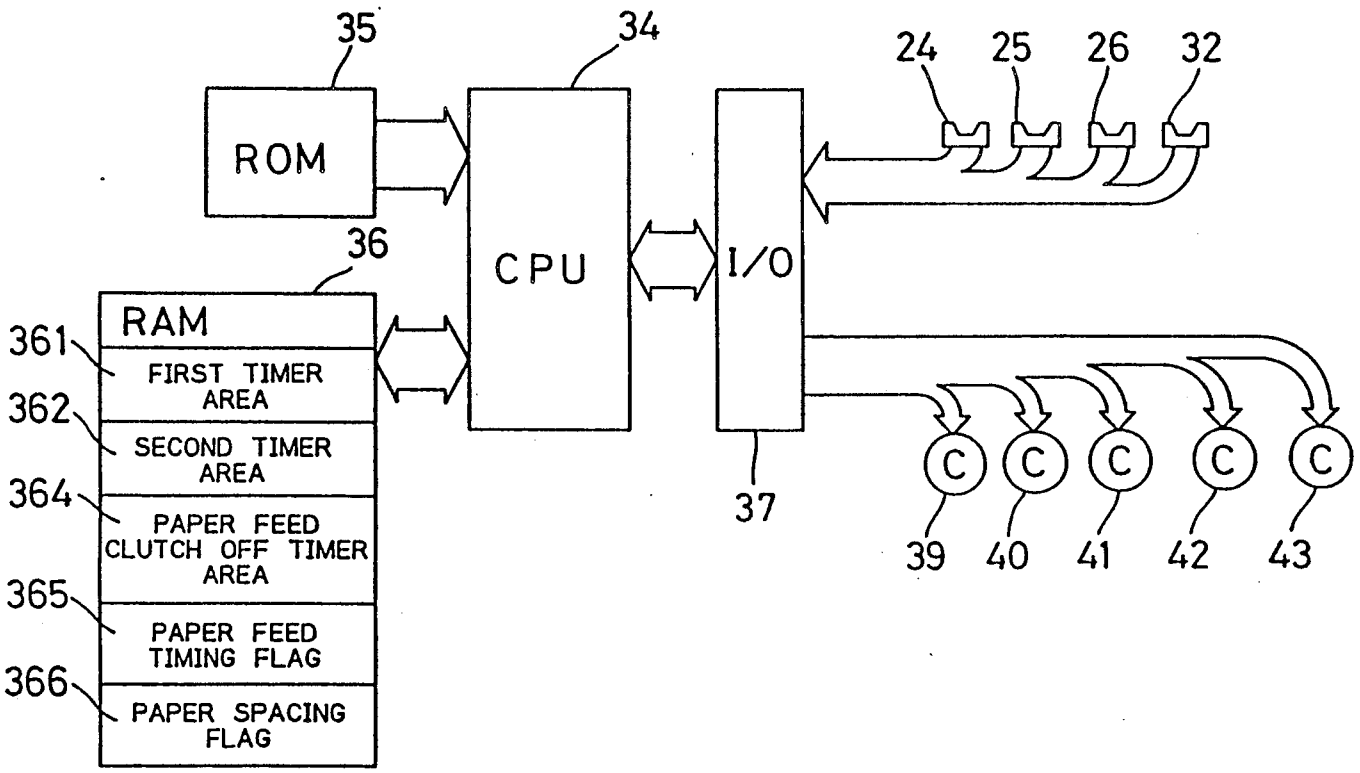
FIG. 6 is a block diagram showing the construction of an electrical circuit according to an embodiment of the second feature of the invention.

FIG. 6 is a block diagram showing the construction of an electrical circuit according to a second embodiment for operating the mechanism shown in FIG. 2. The electrical circuit has a structure comprising a CPU 34 which is a control center, a ROM 35 storing an operation program of the CPU 34, a RAM 36 for storing data or the like, and an input/output interface 37. The RAM 36 comprises a first timer area 361, a second timer area 362, a paper feed clutch off timer area 364, a paper feed timing flag 365, and a paper spacing flag 366 which are required for control as described below.

Figure 5A:
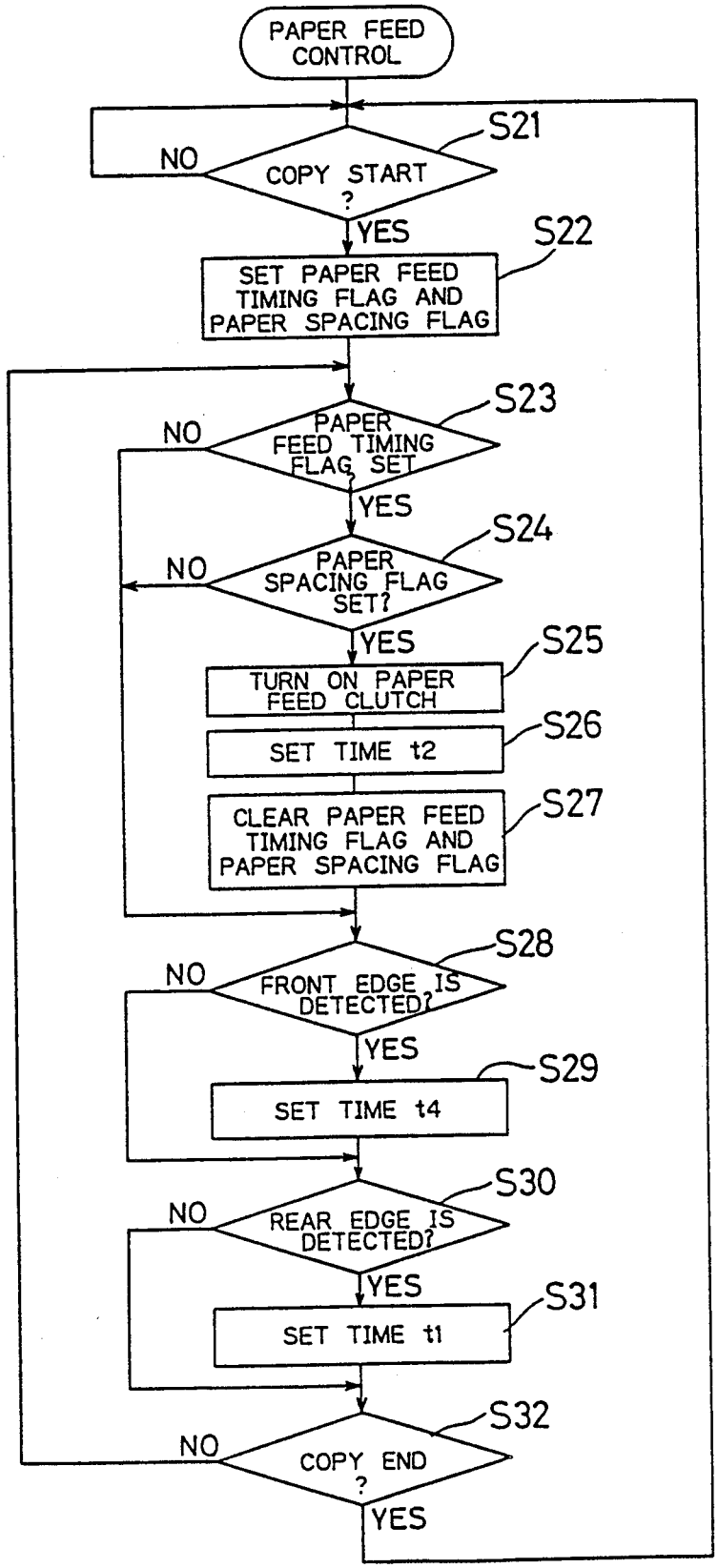
FIG. 5A is a main flow chart showing a control operation according to an embodiment of the second feature of the invention.

FIG. 5A is a main flow chart showing a control operation of the paper feeding mechanism of this electrophotographic copying apparatus.

Figure 7:
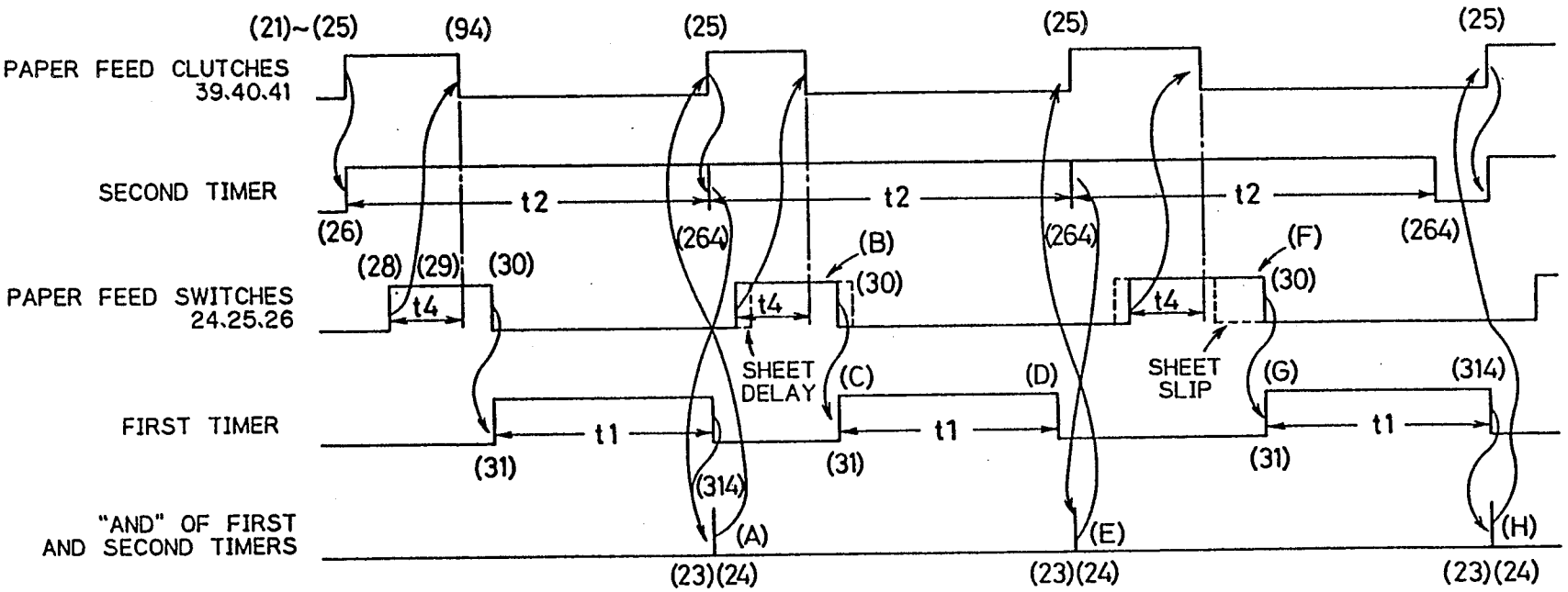
FIG. 7 is a timing chart for explaining a control operation according to the second feature of the invention.

FIG. 7 is a timing chart showing an operation of this electrophotographic copying apparatus, which shows the relation of a paper feed clutch 39, 40 or 41, a second timer, a paper feed switch 24, 25 or 26, a first timer, and an AND output of the second timer and the first timer. In FIG. 7, the sections corresponding to control denoted by numbers of the steps in FIG. 5A are given numbers put in parentheses.

Referring now to FIGS. 2, 6 and 7, description is made of a control operation according to the present embodiment in accordance with the flow of FIG. 5A.

When a copying start signal is applied from a data input section or the like of the electrophotographic copying apparatus, the CPU 34 determines the signal (step S21), to set the paper feed timing flag 365 and the paper spacing flag 366 which is an initial operation for copying on the first paper sheet (step S22).

Then, the CPU 34 determines the state of the paper feed timing flag 365 (step S23), and further determines the state of the paper spacing flag 366 (step S24). In a state in which copying is started, both the flags 365 and 366 have been set in the above described step S22. Accordingly, control proceeds to the step S25. The CPU 34 turns the paper feed clutch 39, 40 or 41 on (step S25), sets predetermined time t2 in the second timer area 362 in the RAM 36 (step S26), and clears the paper feed timing flag 365 and the paper spacing flag 366 (step S27).

The paper feed clutch which is turned on in the step S25 is the paper feed clutch 39, 40 or 41 corresponding to a paper containing section 12, 13 or 14 selected in accordance with the copy mode.

Furthermore, the time t2 set in the second timer area 362 is set to one corresponding to the predetermined ideal spacing with which paper sheets are fed, that is, the spacing between the end of the previous paper sheet and the end of the subsequent paper sheet.

This time t2 differs depending on the size of the paper sheets. Accordingly, it can be determined which of the paper containing sections 12, 13 and 14 is selected to change the time t2 depending on the results of the determination.

Then, the CPU 34 detects a front edge of the paper feed switch 24, 25 or 26 (step S28). When the ends of the paper sheets reach the paper feed switch 24, 25 or 26 after paper sheets start to be fed, the paper feed switch 24, 25 or 26 is changed from the off state to the on state. Accordingly, the CPU 34 detects the edge at that time.

When it detects the front edge of the paper feed switch 24, 25 or 26, the CPU 34 sets predetermined time t4 in the paper feed clutch off timer area 364 (step S29). This time t4 is set to sufficient time required to deliver one paper sheet by the paper feed clutch 39, 40 or 41.

Furthermore, the CPU 34 detects a rear edge of the paper feed switch 24, 25 or 26 (step S30). When the paper sheets finish passing through the paper feed switch 24, 25 or 26, the paper feed switch 24, 25 or 26 is changed from the on state to the off state. Accordingly, the CPU 34 detects the change.

When it detects the rear edge of the paper feed switch 24, 25 or 26, the CPU 34 sets predetermined time t1 in the first timer area 361 in the RAM 36 (step S31). This time t1 is set to one corresponding to the minimum spacing between paper sheets required, that is, the spacing between the rear end of the previous paper sheet and the end of the subsequent paper sheet.

The CPU 34 repeats the control operation in the steps S23 to S31 until it determines that copying is terminated.

Figure 5B:
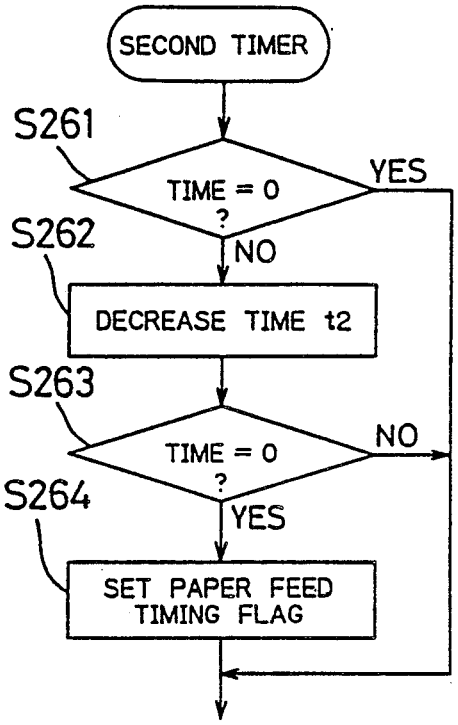
FIGS. 5B, 5C and 5D are flow charts showing a time measuring control operation according to an embodiment of the second feature of the invention.
Figure 5C:
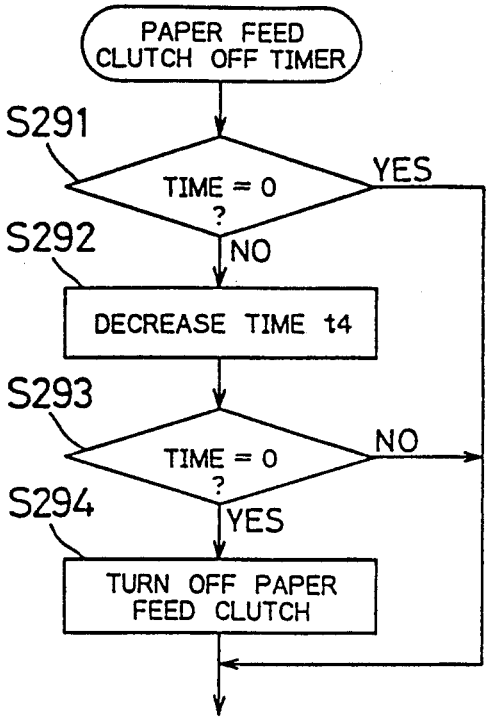
Figure 5D:
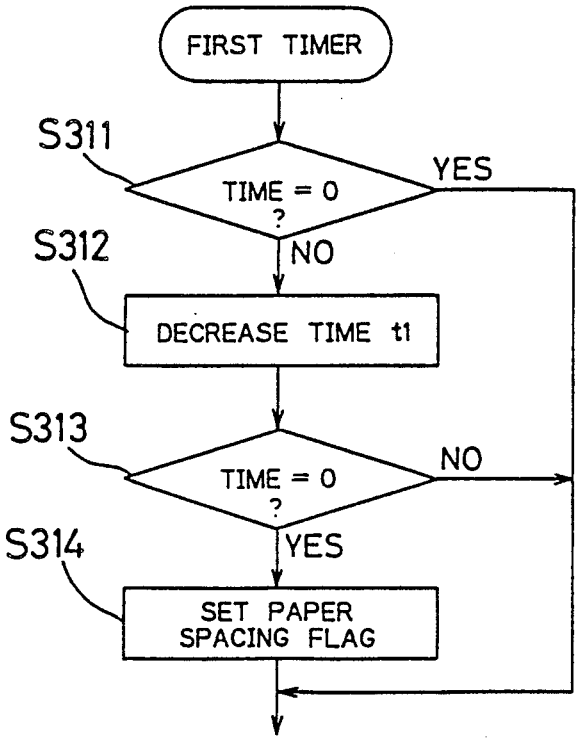

The CPU 34 performs processing in FIGS. 5B, 5C and 5D by, for example, interruption processing in parallel with the foregoing control operation.

More specifically, in the step S26 shown in FIG. 5A, when the time t2 is set in the second timer area 362, the CPU 34 determines that the time is not "0" as shown in FIG. 5B (step S261), subtracts the time (step S262), and sets the paper feed timing flag 365 which is cleared in the step S27 shown in FIG. 5A (step S264).

Furthermore, if the time t4 is set in the paper feed clutch off timer area 364 in the step S29 shown in FIG. 5A, the CPU 34 determines that the time is not "0" (step S291), subtracts the time (step S292), and turns the paper feed clutch 39, 40 or 41 which is turned on in the step S25 shown in FIG. 5A off (step S294) if the time becomes "0" (step S293), as shown in FIG. 5C.

After the paper sheets are delivered, the paper feeding mechanism is stopped by the off-state of this paper feed clutch 39, 40 or 41.

Additionally, if the time t1 is set in the first timer area 361, the CPU 34 determines that the time is not "0" (step S311), subtracts the time (step S312), and sets the paper spacing flag 366 which is cleared in the step S27 shown in FIG. 5A (step S314) if the time becomes "0" (step S313), as shown in FIG. 5D.

When the foregoing interruption processing shown in FIGS. 5B to 5D is performed and both the time t2 measured by the second timer and the time t1 measured by the first timer reach the full count or, alternatively, both the paper feed timing flag 365 and the paper spacing flag 366 are set (steps S23 and S24), the subsequent paper sheet starts to be fed (step S25). Thus, the subsequent paper sheet starts to be fed on condition that both the two timers reach the full count.

Consequently, if the ends of the paper sheets contained are in line with each other and the paper sheets are fed without slipping, both the timers simultaneously reach the full count, whereby the subsequent paper sheet starts to be fed (see FIG. 7 (A)).

If the ends of the paper sheets contained in the paper containing section 12, 13 or 14 are somewhat out of line with each other, the rear edge of the paper feed switch 24, 25 or 26 is shifted as shown in FIG. 7 (B). Accordingly, the time when the first timer is set is changed as shown in FIG. 7 (C), and the time when the first timer reaches the full count is changed (see FIG. 7 (D), in which the time becomes earlier). However, the subsequent paper sheet does not start to be fed earlier than the time when the second timer reaches the full count so long as the second timer normally functions (see FIG. 7 (E)).

The same is true for the reverse. More specifically, the rear edge of the paper feed switch 24, 25 or 26 lags behind by the slip of the paper sheets, as shown in FIG. 7 (7). Consequently, the time when the first timer is set is delayed, as shown in FIG. 7 (G), and the time when the first timer reaches the full count is delayed. Therefore, the time when the second timer reaches the full count becomes earlier. However, the subsequent paper sheet does not start to be fed unless the first timer reaches the full count (see FIG. (H)).

Accordingly, there is no possibility of, for example, the spacing between paper sheets being decreased to desired spacing or less or the paper sheets colliding with each other on the conveying path.

The present invention was described taking an electrophotographic copying apparatus as an example. However, the present invention can be applied to another paper feeding control device such as a printing machine or an electrophotographic type facsimile.

It should be understood that various modifications may be made without departing from the scope of the present invention.

What is claimed is:

1. A paper feeding control device for feeding paper sheets contained in paper containing sections sheet by sheet to an image processing section, said control device comprising:

a paper feeding means for delivering the paper sheets contained in the paper containing sections, a registration means disposed near the image processing section on a paper conveying path for arranging a leading edge of a paper sheet to be delivered to the image processing section, a first paper detecting means for detecting the paper sheet being arranged by the registration means, a second paper detecting means provided at a downstream position from the paper feeding means and at an upstream position from the first paper detecting means on the paper conveying path, for detecting a leading edge and a rear edge of a paper sheet delivered by the paper feeding means, a time measuring means for measuring a constant time period t1 corresponding to a predetermined minimum spacing required between paper sheets, and providing a time-up signal at the expiration of the time period t1, and a paper feeding control means for initiating the time measuring means and for turning on the paper feeding means in response to the detection of the rear edge of one paper sheet by the second paper detecting means, for stopping the paper feeding means once in response to the detection of the leading edge of another paper sheet upstream of said one paper sheet and for resuming operation of the paper feeding means in response to the time-up signal from the time measuring means.

2. The paper feeding control device according to claim 1, wherein the predetermined minimum spacing required between the paper sheets is determined on the basis of spacing between the rear edge of the said one paper sheet and the leading edge of said another paper sheet.

3. A paper feeding control device for feeding paper sheets contained in paper containing sections sheet by sheet to a processing section, said control device comprising:

paper feeding means for delivering the paper sheets contained in the paper containing sections, paper detecting means provided in predetermined positions of a paper conveying path for detecting a leading edge and a rear edge of paper sheets delivered by the paper feeding means, first time measuring means for measuring a time period t1 corresponding to a predetermined minimum spacing required between paper sheets and providing a time-up signal at the expiration of the time period t1, second time measuring means for measuring a time period t2 corresponding to a predetermined ideal spacing with which paper sheets are fed and providing a time-up signal at the expiration of the time period t2, and a paper feeding start control means for starting a time measuring operation by the second time measuring means in response to delivery of a first paper sheet by the paper feeding means, for starting a time measuring operation by the first time measuring means in response to detection of the rear edge of the first paper sheet by the paper detecting means, and for delivering a second paper sheet in response to whichever of the time-up signals provided from the first or second time measuring means is later.

4. The paper feeding control device according to claim 3, wherein the predetermined minimum spacing required between paper sheets is determined on the basis of spacing between the rear edge of the first paper sheet to a leading edge of the second paper sheet.

5. The paper feeding control device according to claim 3, wherein the ideal spacing with which paper sheets are fed is determined on the basis of spacing between the leading edge of the first paper sheet and a leading edge of the second paper sheet.

6. The paper feeding control device according to claim 3, wherein the ideal spacing with which paper sheets are fed is determined depending on which of the paper containing sections is selected.

* * * * *